United States Patent [19]

Zybko

[11] Patent Number: 4,617,210

[45] Date of Patent: Oct. 14, 1986

[54] SELF STICKING CARPET TILES

[75] Inventor: Walter C. Zybko, Lexington, Va.

[73] Assignee: Burlington Industries, Inc., Greensboro, N.C.

[21] Appl. No.: 712,035

[22] Filed: Mar. 15, 1985

[51] Int. Cl.[4] ..... B32B 7/14; D04H 1/08

[52] U.S. Cl. ..... 428/35; 156/291; 428/40; 428/95; 428/196; 428/198

[58] Field of Search ..... 428/95, 40, 196, 198, 428/35; 156/291

[56] References Cited

U.S. PATENT DOCUMENTS 4,242,389 12/1980 Howell ..... 428/95

4,380,563 4/1983 Ayotte ..... 428/40

*Primary Examiner*—Marion C. McCamish

*Attorney, Agent, or Firm*—Cushman, Darby & Cushman

[57] ABSTRACT

A packaging system and method for self stick carpet tiles includes a first group of tiles with adhesive arranged on the bottom surfaces according to a first pattern and a second group of carpet tiles with adhesive arranged on the bottom surfaces according to a second pattern. The first and second group tiles are paired off with their bottom surfaces facing each other. The first and second patterns are chosen so that they do not contact each other when the carpet tile pairs are formed.

16 Claims, 6 Drawing Figures

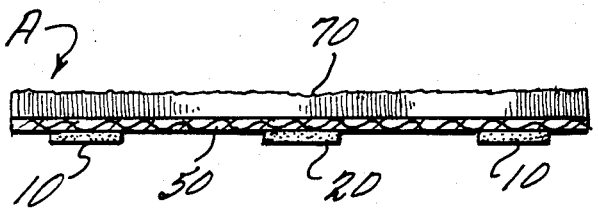
FIG. 4
FIG. 5
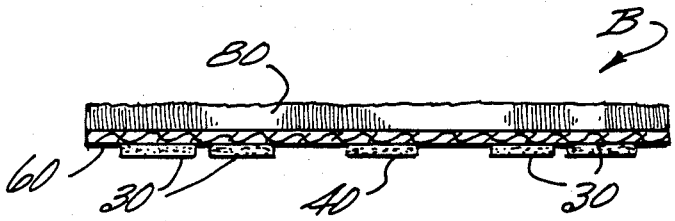
FIG. 6
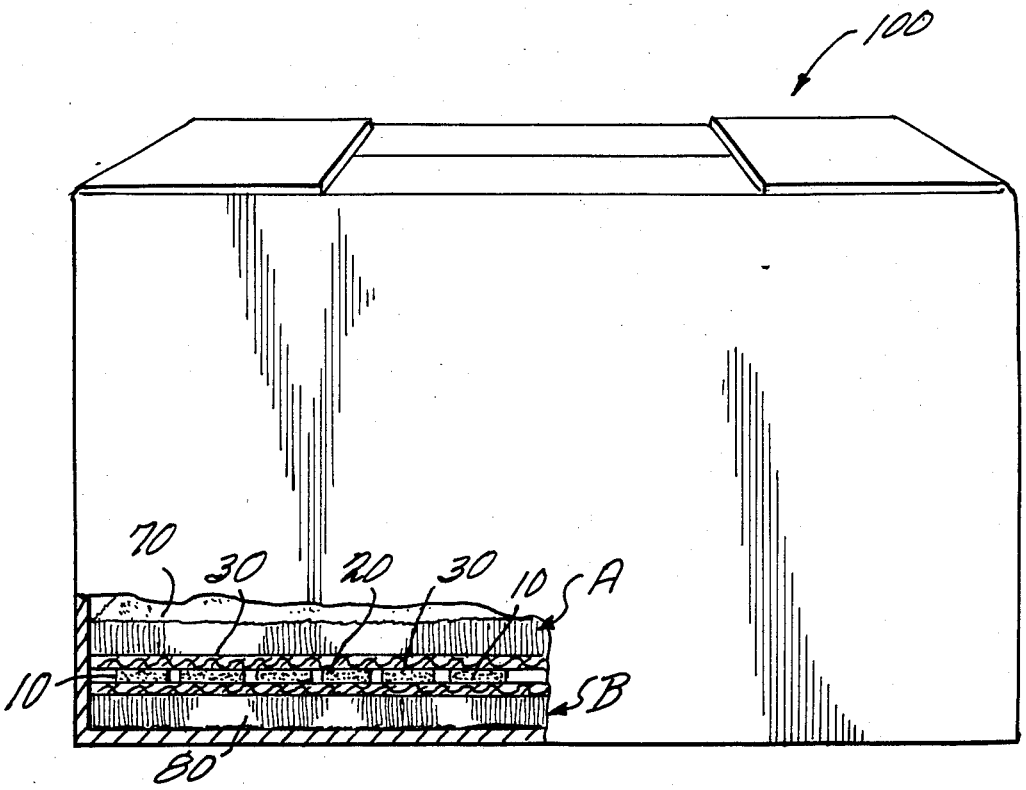

SELF STICKING CARPET TILES

FIELD OF THE INVENTION

The present invention is directed to a method and system for packaging tiles. More specifically, the invention relates to a method and system for packaging carpet tiles of the self-sticking type, which have a pressure release adhesive applied to one surface.

BACKGROUND OF THE INVENTION

There are two types of carpet tiles currently available. A first type requires that a self-release adhesive be applied to the floor on which the carpet tile is to be placed. There are several disadvantages in using this type of carpet tiles, including the need to "seal" a concrete floor in order to prevent the adhesive from being absorbed into the concrete. A second disadvantage is that when the tiles are removed the glue which remains on the floor is both difficult and costly to remove in order to return the floor to its original surface.

Accordingly, the second type of carpet tile, which is commonly known as a self-sticking tile, uses a pressure self-release adhesive cured onto the back of the carpet tile. Such carpet tiles having the self-release adhesive are advantageous over the first type of carpet tiles in that there is no need to "seal" a concrete floor prior to carpet tile installation and when the carpet tiles are removed there is no messy and costly clean up necessary in order to return the floor to its original surface.

Ayotte, U.S. Pat. No. 4,380,563 proposes to package felt substrates having an adhesive applied to one surface of the substrate. Each felt substrate, with an applied adhesive, is separated from another such felt substrate, with an applied adhesive, by a release paper. The release paper is necessary to prevent the adhesive surface of one felt substrate from contacting the finished or exposed felt surface of another felt substrate. The proposed Ayotte packaging is disadvantageous, in that it is costly to provide the release paper during the manufacturing process and the release paper also presents problems of paper disposal during the time of installation of the carpet tiles.

SUMMARY OF THE INVENTION

This invention provides a carpet tile packaging system and method for self-sticking carpet tiles which is an improvement over the prior art packaging methods and systems in that it obviates the above-described disadvantages of the prior art. The pressure self-release adhesive, in the present invention, is applied to the bottom surface of the carpet tiles in one of two predetermined geometrical patterns. The two predetermined geometrical patterns are complementary so that when two tiles with pressure self-release adhesives are placed back to back, the adhesive from one tile will not contact the adhesive from the other tile.

As is well known to those skilled in the art, pressure self-release adhesive can be applied to carpet tiles in several ways. In one way, an aqueous adhesive is used and upon application to the carpet tile the adhesive is cured to the back of the tile by driving out the water by a conventionally known process. A second way of applying pressure self-release adhesive to carpet tiles results in a hot melt process, in which the adhesive is applied hot so that it forms a permanent bond with the carpet tile substrate and upon cooling becomes a release adhesive to anything that it contacts.

Furthermore, the invention can also use a double faced tape in place of the pressure self-release adhesive.

One example of the present invention would be the application of pressure self-release adhesives at the outer most corners of one group of carpet tiles. A second group of carpet tiles would have adhesive placed at locations away from the four outer most corners of the carpet tile, for example, on the outer edges of the tile intermediately located between adjacent corners. Thus, when the carpet tiles are placed back to back the adhesive from one tile would not contact the adhesive from the other tile. Furthermore, because the adhesive has been applied in such a manner that it is cured when applied to its receptor carpet tile, the adhesive is firmly bonded to the carpet tile with a significantly higher bonding strength than the bond which the exposed surface of the adhesive will form with another surface such as the back of another carpet tile or a floor.

When double faced tape is used in place of a pressure self-release adhesive, one side of the double faced tape has superior bonding characteristics as compared to the other side of the double faced tape which is to contact the floor.

Thus, by placing the carpet tiles of the present invention back to back so that their respective adhesives portions do not make contact, the carpet tiles can be packaged without the use of release paper.

Accordingly, the present invention provides the following advantages over the prior art carpet tiles. First, the use of a self-stick tile without the need for release paper saves considerable cost during manufacturing and also obviates any problems of paper disposal for the carpet tile installer. Second, the installer does not need to "seal" a concrete floor in order to prevent adhesive from being absorbed into the concrete, since the adhesive is applied to the back of the carpet tiles. Third, because it is not necessary to apply a coat of adhesive to the floor, substantial savings in time of application, time of curing, the labor of application and the cost of the adhesive result. And finally, when the carpet tiles of the present invention are removed from the floor, since the glue is on the tiles and not on the floor, messy and costly clean ups in order to return the floor to its original surface are avoided.

BRIEF DESCRIPTION OF THE DRAWINGS

FIG. 4 is a cross section of the carpet tile of FIG. 1 along line 4—4;

FIG. 5 is a cross section of the carpet tile of FIG. 2 along line 5—5; and FIG. 6 shows one example of a packaging container for the carpet tiles as assembled in FIG. 3.

DETAILED DESCRIPTION OF THE PRESENT INVENTION

Figure 1:
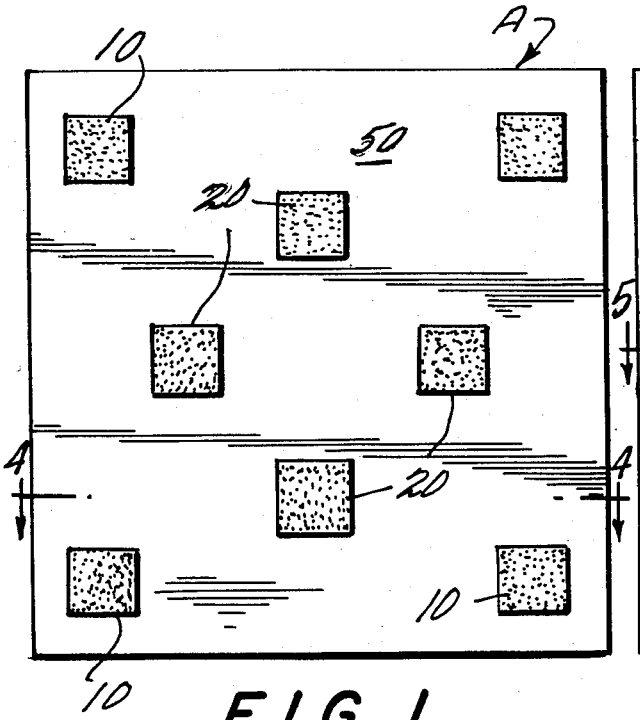
FIG. 1 shows a carpet tile having a first predetermined pattern of adhesive portions mounted on its bottom surfaces.

In FIG. 1 there is shown a first carpet tile A having a bottom surface 50 on which adhesive portions 10 and 20 are formed in a predetermined geometrical pattern. Although the adhesive portions are shown as square in shape in FIG. 1, it will be readily understood to those skilled in the art that any shape of adhesive portions would be suitable, for example, circular, elliptical, striped, etc. FIG. 4 is a cross section of carpet tile A taken along line 4—4. As can be seen in FIG. 4, the adhesive portions 10 and 20 are located on the bottom surface 50 of the carpet tile A opposite to its top surface 70.

Figure 2:
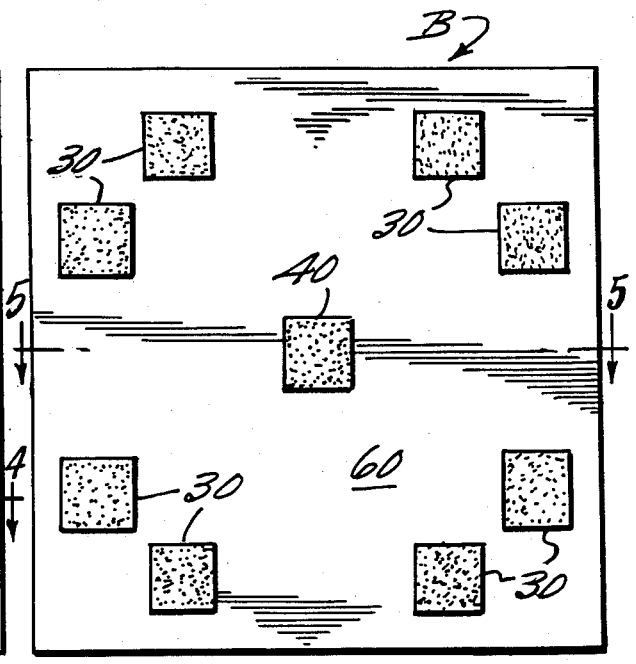
FIG. 2 shows a carpet tile having a second predetermined pattern, which differs from the first predetermined pattern of the carpet tile of FIG. 1.

FIG. 2 shows a carpet tile B having a bottom surface 60 on which are arranged adhesive portions 30 and 40 in a second predetermined geometrical pattern which is complementary to the first pattern of the carpet tile A, as will be described below. A cross section of carpet tile B along line 5—5 is shown in FIG. 5. In FIG. 5, the carpet tile B is shown to have a bottom surface 60 on which adhesive portions 30 and 40 are located opposite to the top surface 80.

Figure 3:
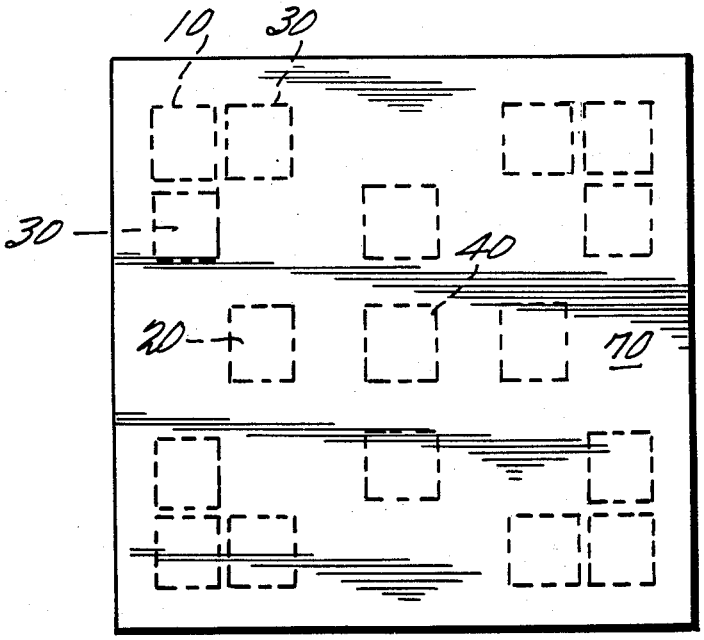
FIG. 3 shows the adhesive patterns when the first carpet tile backing is laid against the second carpet tile backing.

The geometrical arrangement of the first carpet tile A and second carpet tile B are said to be complementary to each other in that the carpet tiles A and B can be placed over top one another with none of the adhesive portions 10, 20, 30 and 40 contacting each other, as shown by the dotted lines in FIG. 3.

FIG. 3 shows the carpet tile A placed against the bottom of the carpet tile B such that the upper surface 70 of the carpet tile A is in view. Thus, the geometrical patterns of the carpet tiles A and B are said to be complementary in that they do not intersect or overlap but result in adhesive portions contacting the respective bottom surface of the adjacent carpet tile. For example, the adhesive portions 10 and 20 of carpet tile A contact the bottom surface 60 of carpet tile B and the adhesive portions 30 and 40 of carpet tile B contact the bottom surface 50 of carpet tile A. Therefore, none of the adhesive portions contact each other.

Since the adhesive portions 10, 20, 30 and 40 have been cured to their respective carpet tiles, they are firmly bonded to the bottom surface of the their respective carpet tile. However, the exposed surfaces of the adhesive portions are characteristic of a pressure self-release adhesive surface so that the carpet tiles can be easily pulled apart from one another, placed into position on a floor surface and pulled up and rearranged as necessary to finalize their position on the floor surface. Furthermore, if and when the carpet tiles are to be removed from the floor surface, they are easily pulled up out of place with the adhesive portions remaining firmly bonded to the carpet tiles.

As noted above, the described construction of carpet tiles therefore allows an inexpensive and efficient packaging method whereby carpet tiles A and B are placed back to back and then stored in a carton or container 100 as shown in FIG. 6. Virtually any type of container can be used for holding the carpet tiles, including straps for strapping a plurality of paired tiles together. Upon removal from the container at the installation site, the carpet tiles are easily pulled apart for placement on the floor surface.

The present invention can be practiced with carpet tiles of virtually any construction. For example, carpet tiles having polyvinyl chloride, ethylene vinyl acetate, polyurethane and atactic polypropylene backings are suitable for the disclosed packaging method and system. Furthermore, carpet tiles with secondary backings such as woven or non-woven polypropylene and polyester are also suitably used with this invention.

The invention may also be applicable to other types of tiles made of cork, ceramic, linoleum, or other materials.

It should be appreciated that the above described description of the preferred embodiment do not limit the scope of the present invention in any way, and that various changes and modifications may be made without departing from the spirit and scope of the present invention.

What is claimed is:

1. A tile system comprising a plurality of tiles having adhesive on the backs thereof for adhering said tiles to a surface, said adhesive being non-releasably applied to said backs, having release properties as to surfaces other than those covered with adhesive, and being arranged on said backs such that two of said plurality of tiles may be placed in back-to-back contact without having their respective adhesives touch, whereby said two tiles in back-to-back contact may be readily separated from one another.

2. A tile system as claimed in claim 1, wherein said tiles are carpet tiles.

3. A packaging system comprising:

a plurality of pairs of tiles each pair having a first tile having a first pattern of adhesive and a second tile having a second pattern of adhesive, said first and second patterns being selected to prevent adhesive areas of said first tile from contacting adhesive areas of said second tile when adhesive sides of said first and second tiles face each other; and container means for holding said plurality of pairs of tiles.

4. A packaging system as claimed in claim 3, wherein said adhesive comprises hot melt adhesive.

5. A packaging system as claimed in claim 3, wherein said tiles comprise ethylene vinyl acetate backings.

6. A packaging system as claimed in claim 3, wherein said first and second patterns of adhesive comprise a plurality of square shaped portions of adhesive cured onto said first and second tiles.

7. A packaging system as claimed in claim 3, wherein said tiles are carpet tiles.

8. A packaging system comprising:

a first group of tiles having adhesive portions applied to a surface in a first predetermined pattern;

a second group of tiles having adhesive portions applied to a surface in a second predetermined pattern, so that when adhesive sides of tiles from said first group face adhesives sides of tiles from said second group, thereby forming pairs of tiles, said adhesive portions are prevented from contacting each other; and container means for holding said pairs of tiles.

9. A packaging system as claimed in claim 8, wherein said adhesive portions comprise hot melt adhesive.

10. A packaging system as claimed in claim 8, wherein said tiles comprise ethylene vinyl acetate backings.

11. A packaging system as claimed in claim 8, wherein said first and second predetermined patterns of adhesive portions comprise a plurality of square shaped adhesive portions cured onto said first and second groups of tiles.

12. A packaging system as claimed in claim 8, wherein said tiles are carpet tiles.

13. A method of packaging a plurality of tiles comprising:

applying pressure sensitive adhesive to the bottom surface of a first group of said plurality of tiles in a first predetermined pattern;

applying pressure sensitive adhesive to the bottom surface of a second group of said plurality of tiles in a second predetermined pattern;

forming a plurality of paired tiles wherein each pair comprises one tile from said first group and one tile from said second group arranged so that their bottom surfaces contact, wherein said first and second predetermined patterns of pressure sensitive adhesive do not contact each other; and placing said paired tiles into a container.

14. A method as claimed in claim 13, wherein an aqueous adhesive is applied in said adhesive applying steps.

15. A method as claimed in claim 13, wherein a hot melt adhesive is applied in said adhesive applying steps.

16. A method as claimed in claim 13, wherein said adhesive comprises a double-faced tape.

* * * * *